US008505351B2

(12) United States Patent
Klatt

(10) Patent No.: US 8,505,351 B2
(45) Date of Patent: Aug. 13, 2013

(54) PRODUCT AND METHOD FOR MANUFACTURING A THREE DIMENSIONAL CORE MASS AND RELATED INVENTIONS

(76) Inventor: Frederick William Klatt, Bedford, MA (US)

( * ) Notice: Subject to any disclaimer, the term of this patent is extended or adjusted under 35 U.S.C. 154(b) by 1060 days.

(21) Appl. No.: 11/924,652

(22) Filed: Oct. 26, 2007

(65) Prior Publication Data

US 2009/0112351 A1 Apr. 30, 2009

(51) Int. Cl.
*B21F 11/00* (2006.01)

(52) U.S. Cl.
USPC ..... 72/132; 72/129

(58) Field of Classification Search
USPC ..... 72/129–132, 146, 148; 700/118, 700/126
See application file for complete search history.

(56) References Cited

U.S. PATENT DOCUMENTS 3,283,399 A * 11/1966 Hart et al. ..... 29/605
5,555,756 A * 9/1996 Fischer et al. ..... 72/41
7,654,123 B2 * 2/2010 Patterson et al. ..... 72/132

* cited by examiner

*Primary Examiner* — Debra Sullivan

(57) ABSTRACT

A three dimensional shape core mass is manufactured by machining a ribbon or tape of any material with various slots, channels, or holes of any shape before the ribbon or tape is spooled or layered onto a layering template or spooler. The machining is adjusted so the slots, channels, or holes of any shape extend in a radial or stacked direction perpendicular to the axis of spooling rotation or the plane of layering but with any curve or straight line and with any stacked length. For example, core masses that are manufactured as described are suitable as magnetic cores for high frequency rotating or linear transformers or for rotors and for stators of rotating or linear electric machines when an appropriate magnetic material is used, such as magnetic metal or amorphous metal ribbon or tape.

18 Claims, 3 Drawing Sheets

PRODUCT AND METHOD FOR MANUFACTURING A THREE DIMENSIONAL CORE MASS AND RELATED INVENTIONS

PRIOR ART

Manufacturing a three dimensional core mass with channels, slots, or holes of any shape or dimension that extend in a radial direction from the reference center of the core mass is accomplished by a three dimensional machining process of the entire raw core mass, which in essence, cuts minute layers of material from the entire raw core until the desire shape is obtained. This has the advantage of a very fast manufacturing process to final core mass shape but can distort or change the structural, physical, electrical, magnetic, and so-on performance of the bulk material of the raw core mass due to excessive mechanical or heat stress as a result of the fast cutting. In some cases, the final product must be annealed to re-establish acceptable performance of the core material. Further, the machine tool experiences similar stress, which reduces the performance and life of the machine tool.

As used herein, "machining" is a process that modifies raw material by cutting, blasting, stamping, punching, grinding, drilling, slicing/scissoring, or etching with any present or futuristic machine tool.

As used herein, "machine tool" is any present or futuristic machine tooling device, such as lasers, water jets, electrostatic cutter, punches and dies, millers, and so-on.

OBJECT OF THE INVENTION

One object of the present invention is to provide a machine tool means to manufacture a three dimensional core mass with slots, channels, or holes of any shape or dimension by machining a ribbon or tape of any raw material with the slots, channels, or holes of any shape one layer at a time before the ribbon or tape is spooled (or layered) onto a layering template or spooler. The machining is adjusted so the slots, channels, or holes of any shape extend in a radial or stacked direction perpendicular to the axis of spooling rotation or the plane of layering but following any curve or straight line and with any stacked depth. For example, core masses that are manufactured as described are suitable for axial air-gap magnetic cores for high frequency rotating transformers; or for rotor cores and for stator cores of axial-flux rotating electric machines when an appropriate magnetic material, such as magnetic metal or amorphous metal ribbon or tape is used as the raw ribbon material. Furthermore, the core masses that are manufactured as described with the appropriate layering template are suitable for linear transformers and electric machines. This method is different from existing methods because after machining, a portion of the outline of the original raw ribbon shape is obviously distinguishable along the length or circumference of the layering plane. Further, the machining is performed as the ribbon is continuously layered for at least one layer. This method is not suitable for radial flux machines.

Still another object of the invention is to provide an alternative means to manufacture axial air-gap magnetic cores for rotating electric machines or transformers or for linear electric machines or transformers. This method hydraulically pumps a powdered metal slurry (i.e., with bonding and lubricating agent) into a mold with a negative image of the desired shape of the core while using a wicking method that purges excess bonding agent from the powdered slurry while adding a composite material of strength.

A further object of the invention is to provide a core design for an axial flux air-gap rotating electric machine or transformer. An axial flux air-gap electric machine has a hockey puck or pancake core and is sometimes referred to as a pancake form-factor electric machine.

DETAILED DESCRIPTION OF THE INVENTION

Figure 1:
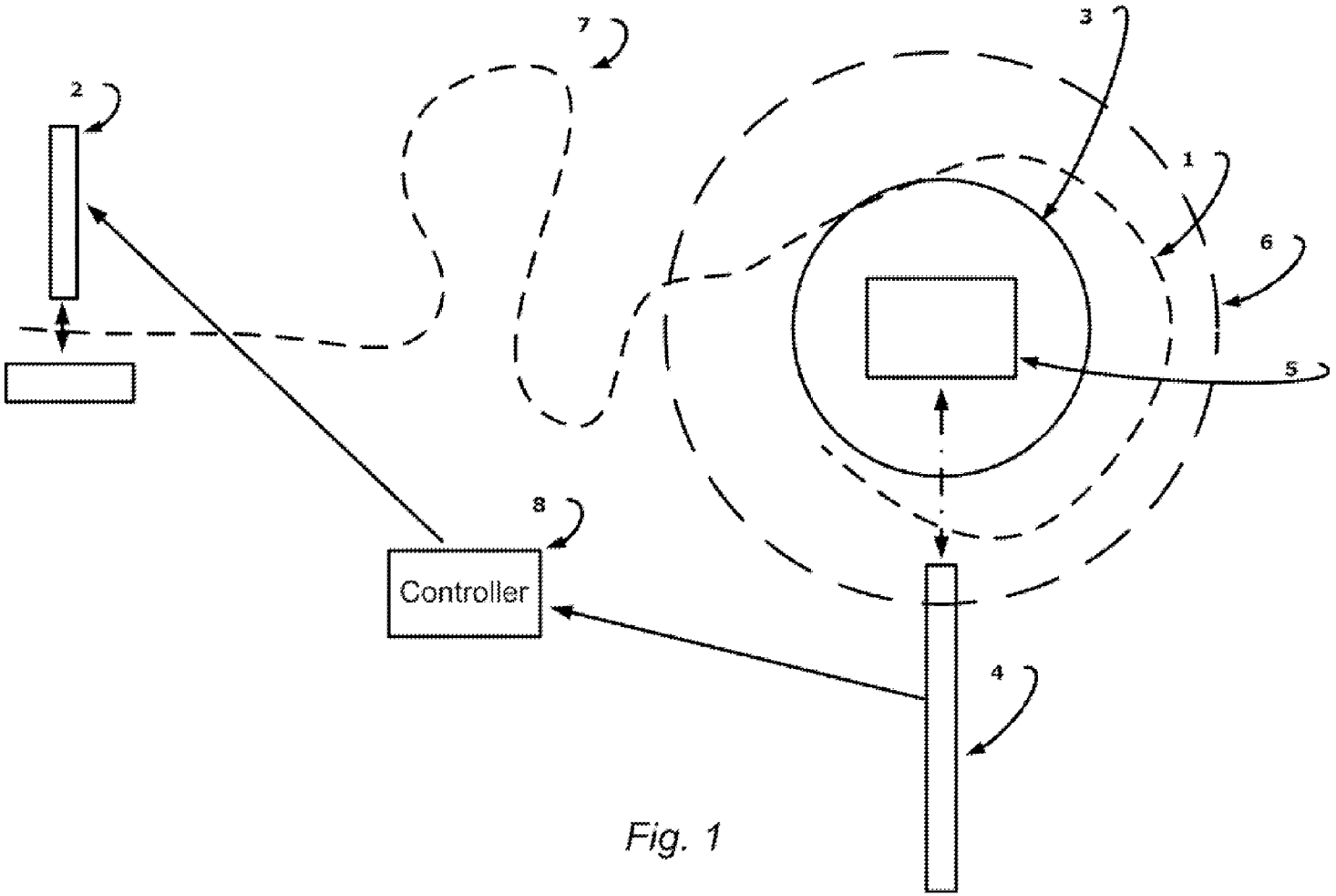
FIG. 1 illustrates the major components of a method of the present invention to manufacture a core mass and the interrelationship between the various major components, such as the remote machining of each layer of ribbon before it is wound onto the spooler.

In some cases, a better approach for certain final three dimensional core shapes and the subject of this patent is to produce the core mass by wrapping, layering, or spooling thin ribbon or tape onto the layering plane of a layering template or spooler of the ribbon.

As used herein, "ribbon" is synonymous with tape and the width and thickness of the ribbon can be any size.

As used herein, "spooling" is synonymous with wrapping, winding, layering, or stacking.

As used herein, "spooled" is synonymous with wound, wrapped, stacked, or layered.

As used herein, "spooler" is synonymous with a layering template that is wound upon, stacked upon, wrapped upon, or layered upon.

As used herein, "radial" direction is synonymous with stacking direction or layering direction.

As used herein, "perimeter" is the length of a layered plane that is measured along the direction of layering and perpendicular to the stacking direction. As an example, it is the circumference of a circular layering plane or the perimeter of a square layering plane.

Before the ribbon is spooled, it is machined with a two-dimensional (i.e., 2-D) shape that is parallel with the layering plane of spooling. The depth of the plane or the third dimension of a layer of the expected three-dimensional (i.e., 3-D) shape depends on the thickness of the ribbon, which is one resolution of machining dimension, and the stacking depth of the layers onto the spooler. Essentially, the final three-dimensional shape is built-up one layer or step at a time, whereby one example a step or layer is one complete rotation of the spooler. It is conceivable to see actual microscopic steps in the final shape, with the step depth based on the thickness of the ribbon. How the 3-D shape evolves in a radial or stacked direction from the layering plane of the spooler depends on how or when every next layer is machined. For instance, a channel could extend in a radial or stacked direction from the layering plane of the spooler along a straight line, a squiggly line, or a curved line. Consequently, any means to acquire the angular position of the spooler (or perimeter dimension) is required to determine or calculate the machining position of the 2-D plane of the ribbon, because as the spooled core extends in the radial direction, the perimeter dimensions of the stacked layers change at least on an angular basis. The template of the spooler assembly can be any shape, such as round, square, triangular, and so-on, but the axis of rotation is in the desired plane of the template while the spooled ribbon is confined by some means in the plane of rotation.

Machining a core mass one thin layer at a time is a slower process with the following advantages. Mechanical or heat stress is reduced because machining is performed on a single thin layer of material, which mitigate collateral damage or performance degradation of the material in the final product. Heat and mechanical stress can be further reduced by localizing an active cooling process, such as forced cooling air, gas, or liquid, directly to the machining process on the thin layer of ribbon rather then the heat mass of the entire core mass. By mitigating the stress, the expensive and time consuming process of annealing may be avoided and the slower process of machining one layer at a time may in fact be more economical and faster. In any case, some core masses, such as magnetic cores of AC transformers or electric machines, require a layered or ribbon structure (i.e., laminated structure) to improve the magnetic and electrical performance of the core and the machining method described causes less collateral damage to the delicate magnetic material for reasons just describe.

FIG. 1 shows one example of the major components of the invention. As the spooler 3 turns, the ribbon 1 wraps around the spooler 3 within the guides (or sleeves) 6 of the spooler. As the spooler turns, the perimeter detector 4 measures the distance traveled by the ribbon with the help of the perimeter focus 5. [In this case, the perimeter is actually the circumference of a circle of varying diameter as the layers of ribbon are applied. If the spooler assembly template (i.e., spooler template) was a square dimension, the measurement would be the perimeter of the square.] The perimeter detector can be a photo detector and the perimeter focus could be a light emitting diode (LED) or a light passing through a template (i.e., slot template) with opaque striations to the distance of focus between the light and the photo detector. Likewise, the perimeter detector could be a hall affect detector, a roller that measures distance, or a adjustable speed or angle drive that effectively measures speed, and so-on with any complementary perimeter focus. On detection, the photo-detector notifies the controller 8, which in turn commands the machine tool 2 to perform its purpose perhaps after shaping calculation, which is to modify the two-dimensional plane (or face) of the ribbon with a shape. How long the machine tool performs its purpose (i.e., machining) could be determined by the controller or the perimeter detector. How the tool performs is many. For instance, one machine tool can work on one edge or surface area or multiple machine tools can perform time and purpose independent or simultaneous operations on specific edges or areas of the ribbon. The ribbon may pass through an indirect path 7 of other enhancing means or components, such as dryers, adhesive applicators, idlers, brakes, a plurality of tooling, etc. Various thickness, width, material ribbon or tape could be spliced during the spooling process to change core dimensions or properties.

Other dimensions could be cut into the ribbon for winding placement, for cooling, or for structural reasons. For instance, slots in a radial direction could be machined for winding placement or for increase cooling surfaces. Channels could be cut to fill with other material for structural support, such as material with high shear or compressive strength for structural rigidity.

Other enhancing means or components may complement or enhance the machining means described. An adhesive application means may be incorporated to apply an adhesive on all or specific layers of the ribbon to bond or add structural support to the final core mass. A drier means may be incorporated to dry any cooling fluid applied to the ribbon before applying any adhesive to the ribbon or to modify the properties of the adhesive. A cleaning means may be incorporated, such as a high pressure blower. A ribbon friction, pulling, braking, or squeezing means may be applied to bring the ribbon layers closer together on the spooler. An automatic spooler (or winder) means may be incorporated to automatically spool the ribbon onto the spooler, such as comparable mechanisms found on film projectors or tape recorders. Additional machine tools that function simultaneously or sequentially may be incorporated to improve machining speed or shape complexity. An annealing means may be incorporated. A means to apply several bobbins of ribbon material could be incorporated to spool layers of ribbon with different dimensions or materials. A means to stop or to brake the ribbon during the process of machining each layer of ribbon. A means to idle the ribbon, such as with an idler arm, during machining of a layer of ribbon may be incorporated. A means to hold the raw ribbon material, such as a bobbin, may be incorporated. A means to guide the ribbon through any of the process means described.

Figure 2:
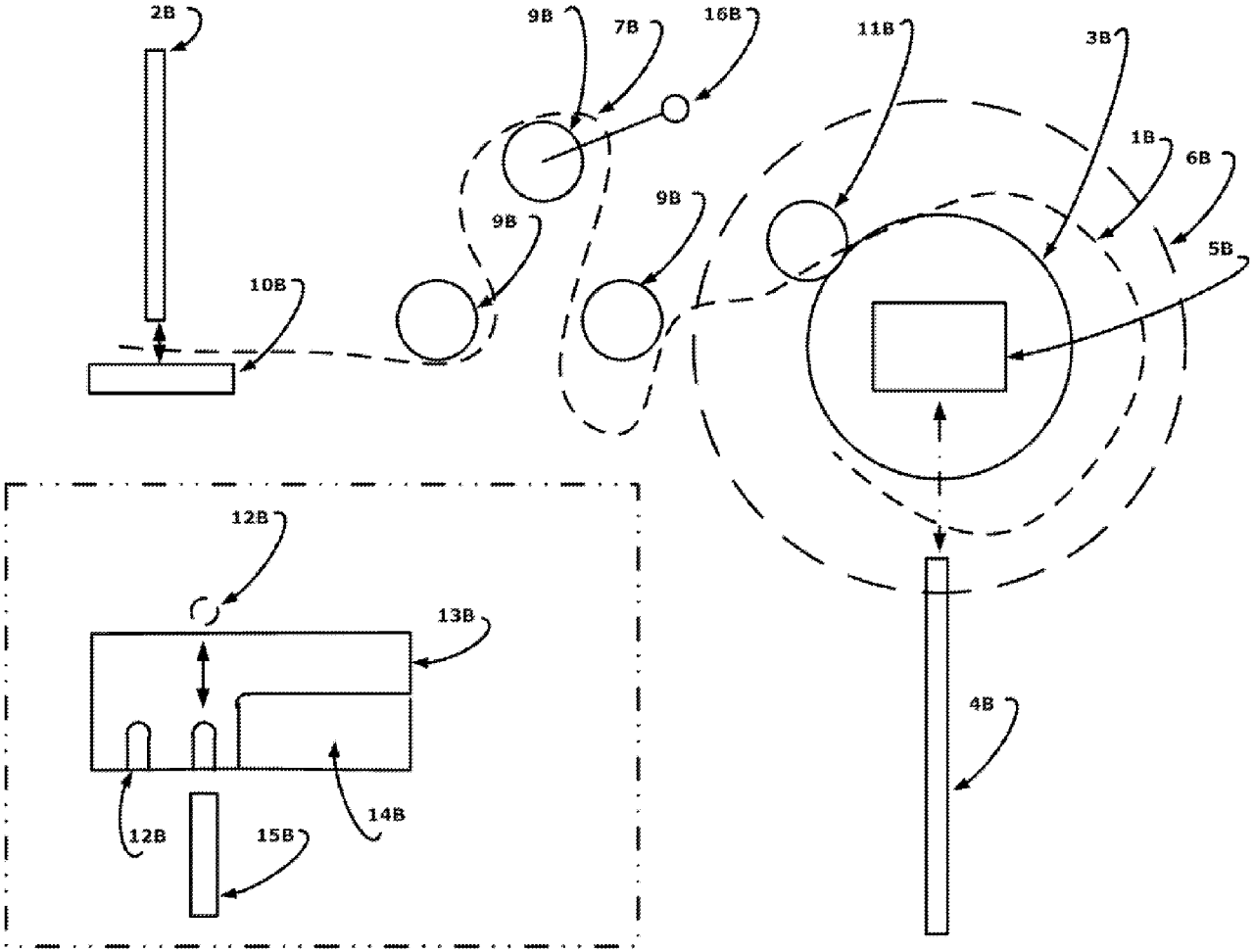
FIG. 2 illustrates a partial system of the present invention with one specific means of machining the ribbon with an illustration of a possible ribbon result. For this specific approach, the illustration shows a slot punch machine tool, a continuously running spooler assembly with a LED (or light) template and photo-detector mechanism that activates the slot punch on a particular angle of the spooler, which is based on the slot template, an idler assembly that compensates or modifies ribbon slack between the continuously running spooler and the discretely running punch and die mechanism, the punch and die machine tool that punches a slot in the ribbon cable when activated by the photo-detector, a friction wheel for tightening the ribbon layers on the spooler, and tape guiding bobbins.

FIG. 2 shows one specific embodiment of the invention with two views: 1) an abstract top down view of the tool; and 2) a break out view, which is an abstract view of the two dimensional plane of the ribbon (i.e., 2D plane or face view of the ribbon in contrast to the edge of the ribbon). Dotted lines, etc., on the top down view are used to differentiate components and do not imply functional attributes, such as a striated ribbon. There are numerous embodiments of the invention with other enhancing means and components as described. As an abstract top down view, the spooling guide 6B provides a precision flat surface where the edge of the edge of the ribbon 7B rests upon as it is spooled with the spooler assembly 3B, which in this example is the flat two dimensional (or 2D) plane (i.e., face) of a rotary table. Generally, the spooler guide 6B moves with the spooler assembly 3B. The spooler assembly 3B comprises a slot template and a spooler template with their integration and construction serving different functions but as an assembly, the slot template and spooler template follow each other's movement, such as by direct shaft connection, gear system, pulley system, etc. The slot template of the spooler assembly 3B comprises pre-calibrated events that when detected by the perimeter detector 4B the machine tool 2B, 15B will be activated, which then cuts the next slot 12B, channel 14B, or any shape into the 2D plane (or ribbon face) of the continuously spooled ribbon. For example, the slot template of the spooler assembly 3B could be a pre-defined disk of evenly spaced (e.g., calibrated) opaque lines or metal tabs about its perimeter, such that when a photo-detector or Hall-effect detector detects the opaque line or metal tab, respectively, the machine tool 2B, 15B is activated to modify or cut a shape (e.g., slot) into the 2D plane of the ribbon. An abstract example of a photo-detection type slot template 12B shows two openings in the slot template that disrupt the light focused on the perimeter detector 4B to activate the machine tool 2B to cut the slot 12B as the slot template turns with the spooler assembly. In contrast, the spooler template of the spooler assembly 3B is a shaped bobbin (i.e., spooler template) onto which the ribbon is wound (i.e., spooled or layered) and as the ribbon is wound about the spooler template of the spooler assembly 3B, the layering takes on a growing shape of the spooler template. In FIG. 2, the spooler template of the spooler assembly 3B is a round template and as a result, the spool of ribbon would be a donut shape. In another example, the spooler template of the spooler assembly 3B could be a square shape and as a result, the spool of ribbon would be the shape of a box frame. 7B, 1B show the path of the edge of the ribbon and ribbon leader, respectively, and not the face or 2D plane of the ribbon. Not distinctly demarcated in FIG. 2, the leader of ribbon 1B, if provided, could be for the initial spooling or for an automatic spooling mechanism. Optional, a slack idler assembly of rollers 9B with at least one roller spring loaded 16B absorbs the slack of the continuously spooled and moving ribbon 7B while the ribbon is naturally stopped by the punch type machine tool 2B, 15B puncturing through the ribbon. Obvious to one with ordinary skill in the art, the absorbing mechanism could be electronically motorized, hydraulic, etc. Obvious to one with ordinary skill in the art, the fixed shaped punch tool could be replaced with a servo-mechanism controlling the x-y coordinates of a laser cutter tool, a plasma cutter tool, etc. The laser cutter system can universally cut any given shape on the 2D plane (or face) of the ribbon, such as a slot 12B, a channel 14B, or etc, while compensating for the continuous movement of the ribbon by controlling the x-y coordinates of the tool to preserve the given shape and as a result, the slack idler assembly 9B may not be needed. Since the cutting on the 2D plane or (face) of the ribbon can be a slot 12B, a channel 14B, or any shape and obvious to one with ordinary skill in the art, etching is tantamount to cutting, etc., "modification" is a term similarly used to describe the process of cutting any shape on the 2D plane of the ribbon by the machine tool 2B. The friction wheel and tape aligner 11B guides the ribbon 7B against the spooler template of the spooler assembly 3B and against the spooling guide 6B. One with ordinary skill in the art realizes there may be more than one friction wheel and tape aligner 11B about the spooler template of the spooler assembly 3B for alignment of the ribbon 7B and for initial auto-spooling of the ribbon before the ribbon acquires one complete layer about the spooler template. Furthermore, the friction wheel and tape aligner 11B may add tension to the ribbon to provide a tighter wrap of ribbon. Obvious to one with ordinary skill in the art, an infinite number of friction wheels and tape aligners 11B about the spooler template of the spooler assembly 3B are tantamount to an alignment belt, cable, etc.

The machine focus 10B is the focal point on the ribbon where the machine tool 2B performs the modification (e.g., shape cutting) on the 2D plane (or face) of the ribbon before the ribbon is wrapped onto previously layered (i.e., spooled) ribbon about the spooler template of the spooler assembly 3B. In contrast, the perimeter focus 5B is the focal point on the spooled ribbon where the modification (e.g., slot cutting) performed at the machine focus 10B eventually wraps and aligns on top of the modifications of the previously layer of ribbon wrapped about the spooler template of the spooler assembly 3B. The machine focus 10B is separated by a trail of ribbon from the perimeter focus 5B. The perimeter detector 4B is the means to detect the perimeter focus 5B where modifications (e.g., slots) are placed on the ribbon spooled about the spooler template of the spooler assembly 3B. Instead of dynamic measurement and calculation of the diameter, the ribbon thickness, the number of layers, etc., the perimeter detector 4B detects calibrated events on a predefined slot template of the spooler assembly 3B. Since the pre-calibrated events on the slot template of the spooler assembly 3B remotely align with the perimeter focus of modifications on the spooled ribbon, detection of each pre-calibrated event by the perimeter detector 4B activates the modifying (i.e., cutting) of the 2D plane of the ribbon at the machine focus 10B with the next shape, such as a slot 12B, channel 14B, etc.

The detection of the events by the perimeter detector 4B will always occur at the same spoke or path emanating from the center of the spooler assembly 3B and as a result, the perimeter focus 5B will be automatically guaranteed (without direct measurement and calculation of the growing diameter of the spooled ribbon) because as the spooler assembly turns at a given speed, the ribbon will correctly move faster as the perimeter (i.e. circumference) gets larger with each wrap of a finite thick ribbon about the spooler template of the spooler assembly 3B; hence, the machine focus 10B and the parameter focus 5B are focused on the same slot alignment. Obvious to one with ordinary skill in the art, the slot template is based on pre-calibrated angle, speed, distance, or time. For instance, if the spooler assembly 3B was held to a precise speed of rotation, then the slot template is the combination of holding the precise speed of the spooler assembly 3B by the perimeter detector 4B with the activation of the machine tool 2B occurring at precise intervals of time. To prevent inaccuracy in slot modification and placement, slip must be eliminated between the ribbon and the spooler assembly 3B, which comprises the spooler template and the slot template that follow the spooler assembly.

The distance between the machine focus 10B and the perimeter focus 5B is a trail of ribbon that adds circumference by a number of wraps on the spooler template before the layering and movement of the spooler template provides the automatic movement to the ribbon for activating the modification without measurement and calculation of the movement but by the slot template mechanism. However, the trail of ribbon adds a predictable and benign skew in the perimeter focus to all slots emanating from the spooler template center. Short of minimizing the distance between the machine focus 10B and the perimeter focus 5B, a ribbon leader 1B, 13B may be used to: 1) allow a leader of ribbon to follow the ribbon path between the machine focus 10B and the perimeter focus 5B, where the modifying position may not be accurate because the ribbon has yet to be spooled on the spooler template; 2) provide a leader of ribbon that will be tightly wrapped about the spooler template for firm transmission of the spooler template movement to the ribbon movement. Perhaps a channel 14B could be introduced into the ribbon leader to nullify any potential modification, such as the introduction of non-overlapping slots. The delay time introduced by the movement of the ribbon between the machine focus 10B and the perimeter focus 5B could be beneficial for the timely control and activation of the modification.

Once the modification is activated by detection of pre-calculated events on the slot template of the spooler assembly 3B by the perimeter detector 4B, the positioning controller of commercial (or custom) machine tools 2B may use measurement and calculation for that specific modification. Obvious to one with ordinary skill in the art, measurement of the movement of the ribbon would be needed to calculate the coordinates of the machine tool 2B to modify the 2D plane of the ribbon with a given predefined shape while compensating for the moving ribbon; however, there is no need to enter thickness of the ribbon in the calculation but thickness of the ribbon may be measured to control the power intensity of the cutting tool to penetrate the thickness of ribbon. Measurement and calculation are never used to determine the activation of the machine tool 2B for next modification of the ribbon but instead, the slot template mechanism is used.

Another embodiment of this invention will incorporate a core mass of powdered metal. Powdered metal with a bonding compound (i.e., powdered metal slurry) can be molded into various shapes, such as shapes with winding slots that are ideal for a magnetic core. The method employed is to manufacture a reusable mold to the negative shape of the desired core mass. The mold will have a separable bulk chamber and a face plate, which covers the mouth of the bulk chamber. The bulk chamber and face plate attach together by any clamping means. Together, the bulk chamber and face plate show the negative shape of the desire core mass. The mold and clamping mechanism will be sufficiently strong to tolerate very high hydraulic pressures. First, a protector material, such as a piece of cellophane, plastic, etc., would be inserted into the bulk chamber to protect the mold from the bonding agent. Second, a piece composite cloth, such as a fiberglass cloth, would be inserted in the bulk chamber. Third, another piece of composite cloth would be laid over the mouth of the bulk chamber followed by another piece of protector material. Both the composite cloth and protector material are allowed to extend outside of the junction between the bulk chamber and face plate junction for wicking purposes. The face plate is attached to the bulk chamber by a clamping means, which can sufficiently hold the hydraulic pressure and allow the composite cloth to act as a wick between the bonding agent and the powdered metal. Powdered metal slurry (i.e., powdered metal and bonding agent) is pumped into the chamber between the composite cloth and the protector material under high pressure. When all cavities of the mold are filled, supplemental pressure will squeeze the excess bonding agent through the wicking junction while leaving the actual powdered metal in the mold cavity with a minimum but sufficient amount of bonding agent. The bonding agent is allowed to set before it is removed from the mold. Various bonding agents require different methods of curing. Powdered Metal core masses for electric machines or rotating transformers can be axial (pancake) or radial flux (cylindrical) design.

It is possible that additional assemblies, which are an integral component of the core mass, may be inserted into the bulk chamber before filling with powdered slurry. For instance, a pre-formed winding assembly may be inserted for rotating transformer. In this case, the winding assembly could be energized or excited to more densely pack the powdered slurry. Likewise, an axle, bearing assembly, and so-on may be inserted.

Figure 3:
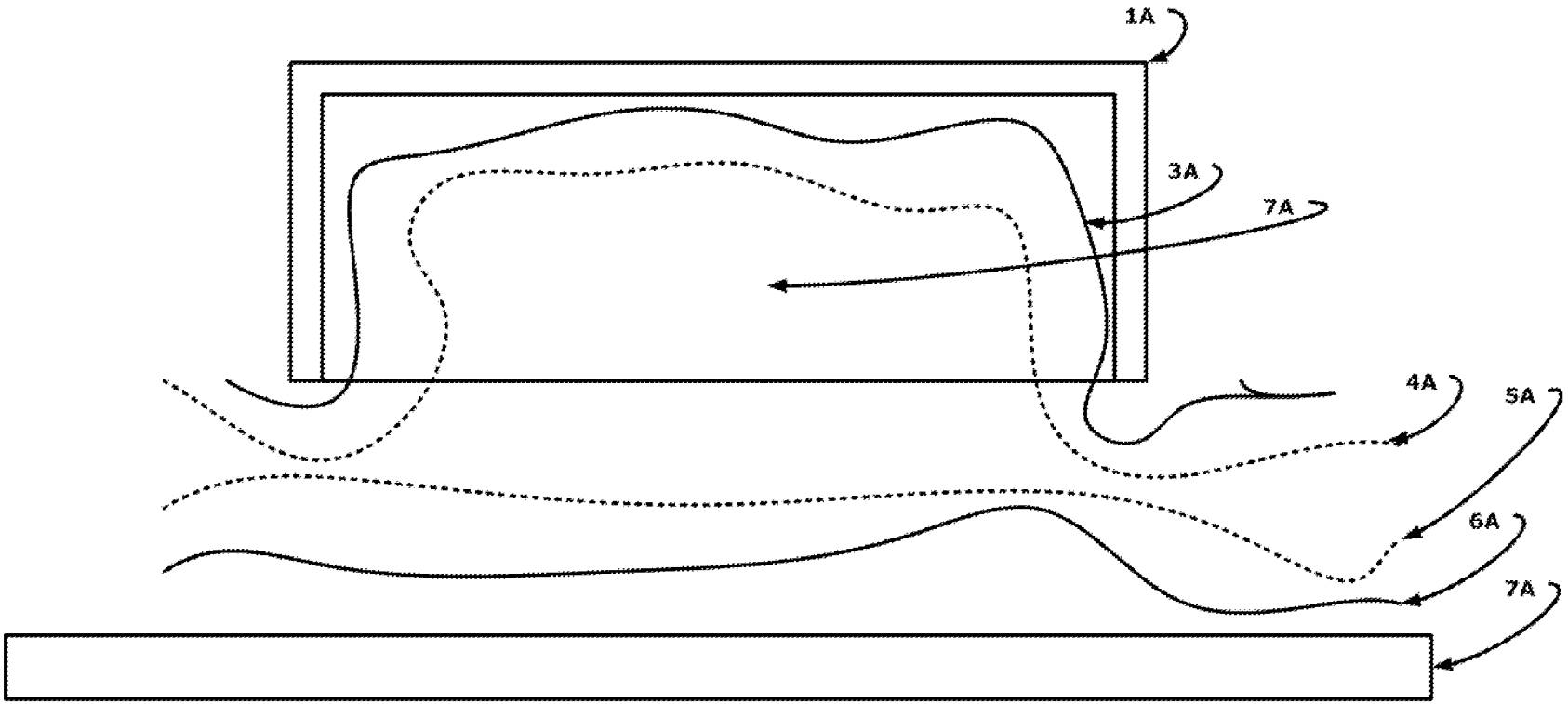
FIG. 3 illustrates an alternative method of this invention to manufacturing a core mass of various shapes by molding with a wicking method of removing excess bonding agent from the powdered metal slurry.

FIG. 3 shows the components of a powdered metal slurry mold. The bulk chamber 1A and face plate 2A are crude representations. All sides of the bulk chamber and face plate oriented towards the chamber cavity 7A will be designed in the negative image of the desired core shape. The protector materials 3A, 6A protect the mold from the bonding agent and for easy removal of the cured core mass. The composite clothes 4A, 5A form a wicking mechanism to allow excess bonding agent to squeeze out while retaining the metal powder. When the bonding agent cures, the composite cloth adds structural integrity to the core mass, as well. In some cases, the composite clothes 4A or 5A or both may be omitted in the process. The powdered metal slurry is pumped into the chamber cavity after the face plate is joined to the bulk chamber by any clamping means that is sufficient to tolerate the hydraulic pressures while simultaneously allowing wicking.

This invention provides a method to manufacture electric machine or high frequency rotating transformer cores of various air-gap area (and power rating) without resorting to customized tooling for each area or power rating. It also allows manufacturing cores with thin magnetic steel laminations or amorphous metal ribbon laminations or powdered metal, which are derivatives of nanocrystalline material. The electric machines or high frequency rotating transformers of particular focus are the Power Generator Motor (PGM) incorporating a Rotor Excitation Generator (REG) of the Electric Rotating Apparatus and Electric Machine patents of this inventor, #4459530, #4634950, #5237255, and #5243268. Like any electric machine, the form-factor of the PGM and REG can be a pancake form-factor (or axial flux). Like any electric machine or rotating transformer, the pancake form-factor incorporates slots for the placement of windings. However, this pancake form-factor with slots is now disclosed for the electric machines and related inventions incorporating Brushless Multiphase Self Commutation Control (or BMSCC).

I claim:

1. A method for manufacturing a three dimensional core mass of at least one ribbon of metal comprising the steps of:

modifying in a two-dimensional plane said ribbon to form a slot, channel or hole in said ribbon; and wrapping said modified ribbon onto at least one spooler with at least one wrap of said ribbon;

wherein said modifying is activated by detection of at least one event from a slot template of pre-calibrated events that follows the movement of said spooler; wherein said pre-calibrated events are selected from a group consisting of angle, distance, speed, and time, and said detection is selected from a group consisting of light, magnetism, and electricity; wherein said spooler serves as a shaping template for said three dimensional core mass; wherein said three dimensional core mass is built up onto said spooler with at least one wrap of said modified ribbon at a time; wherein said modified ribbon extends per wrap in a radial direction from a rotation axis of said spooler.

2. The method of claim 1, further comprising the steps of measuring the movement of said ribbon; and controlling said modifying in the two dimensional plane of said ribbon in accordance to said measuring of said movement; wherein said measuring is selected from a group consisting of angle, distance, speed, and time.

3. The method of claim 1, wherein said modifying is performed on either an edge of said ribbon or a surface of said ribbon.

4. The method of claim 1, wherein said modifying is performed by at least one machining selected from a group consisting of cutting, welding, drilling, stamping, blasting, brazing, grinding, etching, chopping, punching, slicing, electrostatic discharge, acoustic, ultrasonic, light, electric, plasma, annealing, hydraulic, and derivative tooling.

5. The method of claim 4, wherein said modifying further comprises drying said ribbon with at least one drier.

6. The method of claim 4, wherein said modifying further comprises cooling said ribbon with at least one cooler.

7. The method of claim 1, wherein said method further comprises storing said ribbon on at least one bobbin prior to said modifying step.

8. The method of claim 1, wherein said method further comprises guiding said ribbon for manufacturing a three dimensional core mass of ribbon.

9. The method of claim 1, wherein said method further comprises braking said ribbon to allow for modifying of said ribbon with at least one brake.

10. The method of claim 1, wherein a shape of said spooler is selected from a group consisting of cube, ball, square, round, triangular, and trapezoidal.

11. The method of claim 1, wherein said method further comprises applying at least one material selected from a group consisting of adhesive, liquid, air, heat, cold, and paint to said ribbon with at least one applicator.

12. The method of claim 1, wherein said method further comprises splicing said ribbon with at least one splicer, wherein determination of said splicing is selected from a group consisting of material, size, width, and thickness of said ribbon.

13. The method of claim 1, wherein said method further comprises mitigating variation in ribbon movement with at least one idler.

14. The method of claim 1, wherein said method further comprises at least one method of finishing said ribbon to mitigate anomalies after said modifying step.

15. The method of claim 1, wherein said method further comprises automatically guiding said ribbon with a moving flexible belt; wherein said moving flexible belt surrounds said spooler to guide said ribbon about said spooler.

16. The method of claim 1, wherein said method further comprises annealing said ribbon.

17. The method of claim 1, wherein said method further comprises either monitoring said ribbon or monitoring said modifying step with a monitoring system, whereby the performance of said modifying can be corrected.

18. The method of claim 1, wherein said spooler during said wrapping further acts as a precision guide for aligning said ribbon onto said spooler.

* * * * *